United States Patent [19]

Bauer

[11] 4,092,731

[45] May 30, 1978

[54] DEVICE FOR SUPPRESSING MULTIPLE REGISTRATIONS IN A DATA STORE

[75] Inventor: Lothar Bauer, Hondelage, Germany

[73] Assignee: Siemens Aktiengesellschaft, Berlin & Munich, Germany

[21] Appl. No.: 756,740

[22] Filed: Jan. 4, 1977

[30] Foreign Application Priority Data

Jan. 12, 1976 Germany ..... 2600869

[51] Int. Cl.[2] ..... G06F 7/02

[52] U.S. Cl. ..... 364/900

[58] Field of Search ..... 364/900

[56] References Cited

U.S. PATENT DOCUMENTS

| | | | |
|---|---|---|---|
| 3,493,935 | 2/1970 | Questa | 340/172.5 |
| 3,571,807 | 3/1971 | Candy et al. | 340/172.5 |
| 3,732,547 | 5/1973 | Etra | 340/172.5 |
| 3,836,768 | 9/1974 | Clarke et al. | 246/3 |

*Primary Examiner*—Gareth D. Shaw
*Assistant Examiner*—C. T. Bartz
*Attorney, Agent, or Firm*—Hill, Gross, Simpson, Van Santen, Steadman, Chiara & Simpson

[57] ABSTRACT

A device for the suppression of multiple registrations of identical data in a data store, as a result of shuttle movements between inquiry and response devices of the data transmission system, which devices are movable relative to one another, particularly in a system for the automatic number-reporting of freight cars, and for point-to-point train control in railroading, in which data is alternately stored in one of two stores, prior to supply to the data store, with the data transmitted to the inquiry device from the most recently interrogated response device and from the previously interrogated response device being compared and, in the presence of differing data, in the two stores, supplies the most recently read-in data to the data store.

2 Claims, 1 Drawing Figure

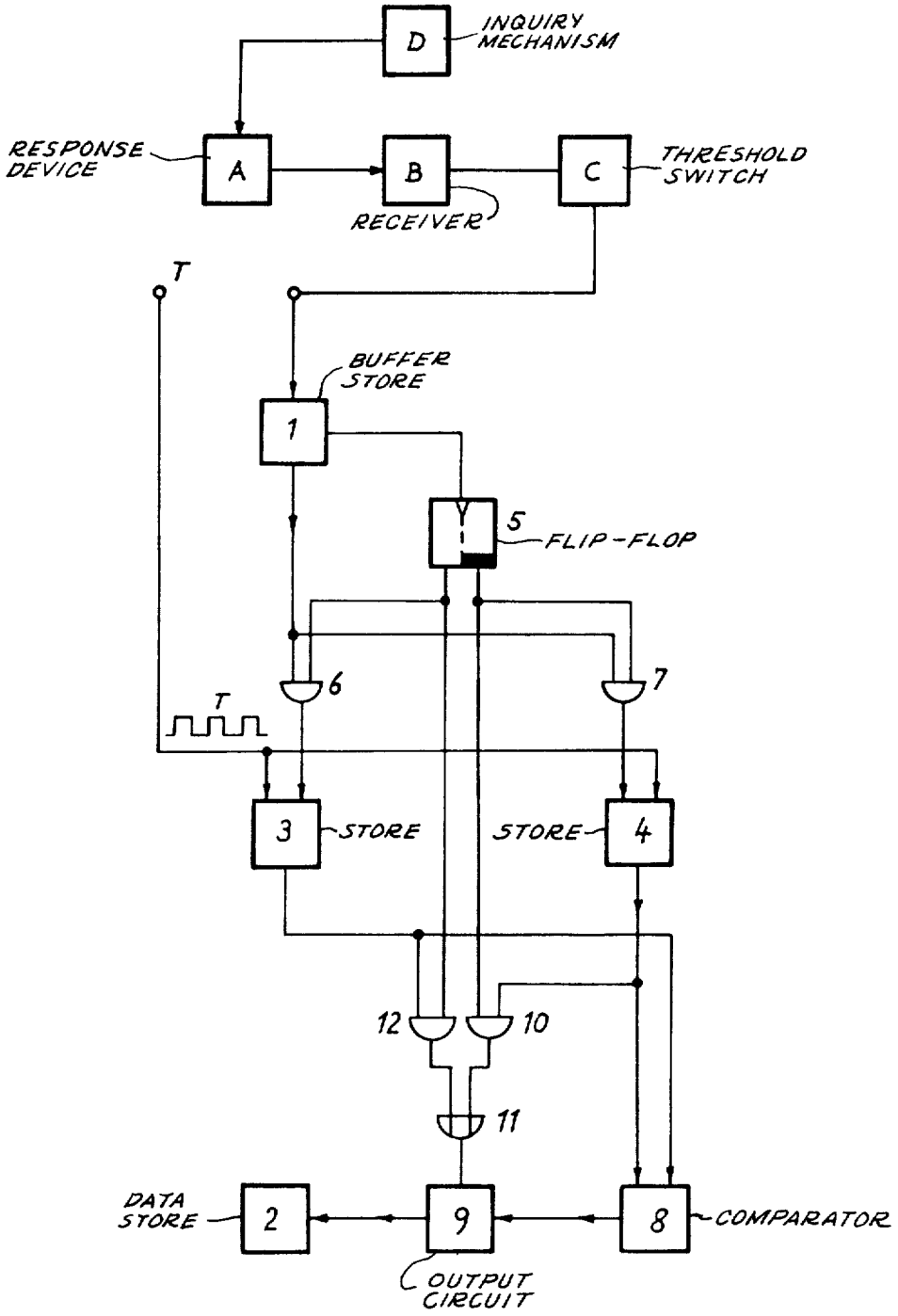
D
INQUIRY MECHANISM
RESPONSE DEVICE
A
B
C
THRESHOLD SWITCH
RECEIVER
T
BUFFER STORE
1
5
FLIP-FLOP
6
7
T
3
STORE
STORE
4
12
10
11
DATA STORE
2
9
8
COMPARATOR
OUTPUT CIRCUIT

DEVICE FOR SUPPRESSING MULTIPLE REGISTRATIONS IN A DATA STORE

BACKGROUND OF THE INVENTION

The invention relates to a device for the suppression of multiple registrations of identical data in a data store, resulting from shuttle movements between the inquiry and response mechanisms of a data system, in which such mechanisms are movable relative to one another. The invention is particularly applicable to a system for the automatic number reporting of freight cars, and for point-to-point train control in the railroading field.

In data transmission systems involving inquiry and response mechanisms which are movable relative to one another, as a result of shuttle movements between the inquiry and response mechanisms, occasionally the same data is multiply transmitted. Thus, in the railroading field, for example, in a system for automatic reporting of freight car numbers, the car number of a freight car can be multiply transmitted to an interrogation or reading device if the car involved shuttles back and forth in the vicinity of the inquiry device, and thus repeatedly passes the inquiry point or the reading range of the inquiry device. Shuttle movements of this type can, for example, be caused in switching operations by the nonuniform movement of the cars, carrying the response devices, over the switching hump. The freight car number derived in the response device is then multiply transmitted to the inquiry device and multiply stored in an associated data store. As a result of such multiple registrations of the same freight car numbers, the numbers stored in such data store no longer correspond to the actual operational conditions.

If the data stored in the data memory is to be effectively utilized for further control and regulation in the operation, multiple registrations of identical data must be suppressed. In systems in which a particular directional movement is involved of the inquiry or response devices, or is specifically established, the desired results may be achieved, for example, by the use of devices which constantly determine the actual movement direction of the vehicles and which, in the case of an actual movement direction deviating from the prescribed movement direction, effects an erasure of the most recently read-in data. However, such devices are relatively costly and further, substantially increase the susceptibility to system disruption and failure. In addition, this type of operation has the disadvantage that, when there is a reverse movement of a car device within the range of the inquiry device, a car number could be lost, as a result of which the stored content of the data store again does not correspond to the actual operational conditions.

BRIEF SUMMARY OF THE INVENTION

The present invention therefore has among its objects the production of a device for the suppression of multiple registrations of identical data in a data store, which does not require special devices for determining the movement direction of the inquiry or response devices, thus not only providing favorable cost and relatively minimum susceptibility to interference, but also is usable in the case of movement reversal of one device within the effective range of the other device.

This objective is accomplished in the invention by the utilization in the inquiry device of two stores, in which the data transmitted to the inquiry device from the most recently interrogated and from the previously interrogated response devices can be stored, at time of reception, with the outputs of such stores being conducted to a comparator which effects entry in the data store of the most recently read-in data when differing data appears in each of said two stores.

BRIEF DESCRIPTION OF THE DRAWING

The FIGURE of the drawing illustrates, in block form, the schematic circuit of a data transmission system of the type involved, illustrating the application of the present invention thereto. The circuit illustrated involves primarily that portion of the system involving the screening out of multiply received data, and such portions of the circuitry not essential to an understanding of the invention have been omitted for the purposes of clarity.

DETAILED DESCRIPTION OF THE INVENTION

Referring to the drawing, data received by a response device A is transmitted to the receiver B, of the inquiry device, from which it is conducted over a threshold switch C to a buffer store 1. The arrangement is such that the received data is supplied over the threshold switch C when the reception energy of the response signals initially exceeds a lower threshold value, following which the line value falls below the threshold value, and such evaluation forms the criterion for the mutual passing between a response device and an inquiry device. The buffer store 1 functions to match the working speed of the actual inquiry mechanism D of the inquiry device to the working speed of the data store 2.

Following the buffer store 1, two stores 3 and 4 are provided, in which data transmitted to the inquiry device, from the most recently interrogated and from the previously interrogated response device, can be stored following reception of such data.

The received data is alternately stored in one or the other of the stores 3 and 4, which operation is controlled by a flipflop 5, in turn controlled by the buffer store 1, whereby upon each actuation of the latter, the flipflop is reversed in its switching position and thus alternately applies control potential to the control input of an AND member 6 or a like member 7, which are interposed between the buffer store 1 and the respective stores 3 and 4, respectively. The other respective inputs of the AND members 6 and 7 are connected to the output of the buffer store 1, whereby the contents of the buffer store 1 may be supplied to either the store 3 or the store 4, in dependence upon the position of the flipflop 5. It will be appreciated that the changeover frequency of the flipflop 5 thus is solely dependent upon the data sequence at the input of the buffer store 1.

The outputs of the respective stores 3 and 4 are conducted to respective inputs of a comparator 8, which is adapted to control an output circuit 9, which in turn controls the entry of data into the data store 2. The supply of data, from either store 3 or store 4, to the output circuit 9 and then to the data store 2, is determined by two AND members 10 and 12, under the control of the flipflop 5 and a mixing member 11, for example, an OR gate. Thus, with the flipflop 5 in the position illustrated in the drawing, the AND members 7 and 10 would be enabled, and data from both stores 3 and 4 would be supplied to the comparator 8. If there is differing data in the two stores 3 and 4, the data in the most recently read-in store is supplied to the data store.

It will be apparent that which of the stored data in the respective stores 3 and 4 was the last received would be determined by te switching position of the flipflop 5, which in this case would be the data in the sotre 4. If the flipflop 5 were in the other switching position, then only the data stored in the store 3 would be fed to the data store 2 over the AND member 12 and mixing member 11.

If following the registration of data in the data store 2, the same data is again supplied to the buffer store, the comparator 8 then determines correspondence of the data stored in the stores 3 and 4 and, by means of the output circuit 9, prevents the repetitious storage of such data into the data store 2.

While, basically, stores 3 and 4 and the comparator 8 can be constructed in any desired technique, expediently the stores 3 and 4 may be constructed as dynamically-driven shift registers, connected in a ring with such registers stepped cyclically and synchronously along by a suitable shift pulse. The data circulating in the stores 3 and 4 can then be picked up, bit by bit, by an inexpensive comparator 8 at the storage places of the shift registers corresponding to one another and thus compared.

It will be appreciated that in the above description, there has been eliminated in the disclosure, circuitry not absolutely necessary for the explanation of the present invention, as for example, the means for synchronization of the data received into the buffer store, with the already stored data, as well as the representation of linking or blocking circuitry which provides that after the reception of new data in the data store, the output signals of stores 3 and 4 are inoperative until the arrival of additional data.

The invention is not limited merely to systems for the automatic number-reporting of freight cars but is also applicable, for example, for point-to-point train control in railroading, in which the inquiry devices may be disposed on the railroad cars and the response devices along the line. Likewise, the invention is also applicable for all data transmission systems with inquiry and response devices which are movable relative to one another, in connection with which multiple reception of sata may be anticipated because of shuttle movements between the inquiry and the response devices.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In a device for the suppression of multiple registrations of identical data store because of shuttle movements between inquiry and response devices of a data transmission system, which devices are movable relative to one another, particularly in a system for automatic number-reporting of freight cars and for point-to-point train control in railroading, the combination of an inquiry device having a buffer store in which data transmitted to the inquiry device from a response device are initially stored upon reception of such data, a pair of AND-members, a bistable flipflop having its trigger input opertively connected to said buffer store and its respective outputs connected to first inputs of said two AND-members, the second inputs of which are connected to the output of the buffer store, a pair of stores having their inputs connected to respective outputs of said AND-members, and a further pair of AND-members, the outputs of said stores being connected to respective first inputs of said further AND-members, the second inputs thereof being connected to respective outputs of said flipflop, an output circuit, a mixing member connecting the outputs of said further AND-members to said output circuit, and a comparator, the output signal of which controls said output circuit, said comparator being coupled to the outputs of said pair of stores and switching the output circuit in the presence of differing data in the two stores.

2. A device according to claim 1, wherein said two stores are constructed in the form of dynamically driven, synchronously circulating shift registers, with said comparator comparing, bit by bit, the output signals which can be obtained at mutually corresponding storage points of the two stores.

* * * * *